US007146736B1

(12) United States Patent
Collins

(10) Patent No.: US 7,146,736 B1
(45) Date of Patent: Dec. 12, 2006

(54) FOLDING KNIFE WITH CANTILEVERED SPRING

(76) Inventor: Walter W. Collins, P.O. Box 100, North, SC (US) 29112

( * ) Notice: Subject to any disclaimer, the term of this patent is extended or adjusted under 35 U.S.C. 154(b) by 0 days.

(21) Appl. No.: 10/930,028

(22) Filed: Aug. 30, 2004

(51) Int. Cl.
*B26B 1/04* (2006.01)

(52) U.S. Cl. ..... 30/160; 30/159

(58) Field of Classification Search ..... 30/155, 30/158, 159, 160, 161
See application file for complete search history.

(56) References Cited

U.S. PATENT DOCUMENTS

| | | | | | |
|---|---|---|---|---|---|
| 273,858 | A | | 3/1883 | Korn | |
| 592,612 | A | | 10/1897 | Johnson | |
| 698,080 | A | | 4/1902 | Treas | |
| 736,525 | A | * | 8/1903 | Kaufmann | 30/159 |
| 988,068 | A | * | 3/1911 | Folts et al. | 30/161 |
| 1,087,788 | A | * | 2/1914 | Larsen | 30/159 |
| 1,185,725 | A | * | 6/1916 | Schrade | 30/159 |
| 1,319,532 | A | * | 10/1919 | Rasmussen | 30/159 |
| 1,603,914 | A | | 1/1926 | Hermann | |
| 1,810,031 | A | * | 6/1931 | Schrade | 30/159 |
| 1,810,999 | A | * | 6/1931 | Brown | 30/159 |
| 2,407,897 | A | * | 9/1946 | Newman | 30/159 |
| 2,601,999 | A | | 7/1952 | Sly | |
| 3,568,315 | A | * | 3/1971 | Smith | 30/161 |
| 3,783,509 | A | * | 1/1974 | Lake | 30/161 |
| 4,268,960 | A | | 5/1981 | Reinschreiber | |
| 4,347,665 | A | | 9/1982 | Glesser | |
| 4,570,341 | A | | 2/1986 | Konneker | |
| 5,095,624 | A | | 3/1992 | Ennis | |
| 5,400,509 | A | | 3/1995 | Collins | |
| 5,511,310 | A | | 4/1996 | Sessions et al. | |
| D397,282 | S | | 8/1998 | Derkatz | |
| 5,815,927 | A | | 10/1998 | Collins | |
| 5,819,414 | A | | 10/1998 | Marifone | |
| 5,826,340 | A | | 10/1998 | Hull | |
| 6,145,202 | A | | 11/2000 | Onion | |
| 6,308,420 | B1 | | 10/2001 | Moser | |
| 6,397,477 | B1 | | 6/2002 | Collins | |
| 6,834,432 | B1 | * | 12/2004 | Taylor, Jr. | 30/161 |
| 2003/0070299 | A1 | | 4/2003 | Frazer | |
| 2004/0020058 | A1 | * | 2/2004 | Vallotton | 30/160 |
| 2004/0261272 | A1 | * | 12/2004 | Moser | 30/160 |
| 2006/0059694 | A1 | * | 3/2006 | Carter, III | 30/159 |

* cited by examiner

*Primary Examiner*—Hwei-Siu Payer
(74) *Attorney, Agent, or Firm*—Leatherwood Walker Todd & Mann, P.C.; Thomas W. Epting

(57) ABSTRACT

An assisted opening folding knife having a blade with an engagement surface extending generally radially outwardly with respect to the pivot axis of the blade. A cantilevered leaf spring contacts the engagement surface and immediately urges the blade to the extended position upon the blade pivoting through a predetermined angle from the retracted position. An elongated engagement member is pivotally connected to the handle and configured for pivoting between a blade locking position and an unlocking position. In one embodiment, the cantilevered leaf spring also urges the engagement member towards the blade locking position. The engagement member automatically locks the blade in the extended position, and the cantilevered leaf spring, the blade, and the engagement member all substantially extend in the pivot plane.

18 Claims, 4 Drawing Sheets

FOLDING KNIFE WITH CANTILEVERED SPRING

BACKGROUND OF THE INVENTION

This invention relates generally to an assisted folding knife.

Various versions of folding knives are known, one such version being assisted-opening knives. Assisted opening knives generally require the user to initiate movement of the blade from the folded, or, retracted, position towards the extended position, and at a certain point, the blade automatically continues from that point towards the extended position. In the extended position, the blade may either be locked manually, automatically, or remain unlocked.

Numerous folding knife designs have been patented. For example, U.S. Pat. No. 273,858, issued to Korn, discloses a folding knife having a leaf-type spring for moving a blade to an extended position. U.S. Pat. No. 1,603,914, issued to Hermann, discloses a folding knife having a coil spring connected to a metal tape, which pulls the blade to a retracted position. U.S. Pat. No. 2,601,999, issued to Sly, discloses a foldable gaff hook having a similar opening mechanism. U.S. Pat. No. 2,407,897, issued to Newman also discloses a spring for pivoting blade open upon actuation of a locking lever. U.S. Pat. No. 698,080, issued to Treas, also discloses use of an actuating spring for pivoting a blade to an open position.

SUMMARY OF THE INVENTION

Generally, one aspect of the present invention includes an assisted opening knife, and includes providing a handle having a blade pivotally connected to the handle for pivoting between an extended position and a retracted position with respect to the handle. In one preferred embodiment, the knife includes biasing member, such as an elongated cantilevered leaf spring, having one end fixed to the handle and the free end configured for contacting the blade.

The blade includes a tang having an engagement portion against which the free end of the spring bears upon the blade being moved to a predetermined position from the retracted, or, closed, position towards the extended, or, open, position. The spring and engagement portion are configured such that upon the spring contacting the engagement portion, the spring immediately biases the engagement portion away from the retracted position, and, in turn, the blade towards the extended position.

The knife also includes, in one preferred embodiment, a lock member pivotally connected to the handle and pivotable between a blade locking position and an unlocked position. The lock member is biased towards the blade locking position with a biasing member, means, or spring. The lock member is configured such that it automatically pivots to the blade locking position to lock the blade upon the blade being in the extended position. In one preferred embodiment, the blade, leaf spring, lock member, and lock member biasing means all extend generally in and parallel to the same plane.

In other embodiments of the present invention, the biasing member, such as the cantilevered leaf spring used to bias the blade towards the engagement position, also biases the lock member towards the blade locking position. In one such embodiment, the cantilevered spring includes an apex portion which bears against the lock member to bias the lock member towards the blade locking position. In another such embodiment, the lock member includes a projection which is engaged by the cantilevered leaf spring, and such leaf spring biases the locking member towards the blade locking position.

The present invention also includes a method of opening a knife with a cantilevered spring and for biasing a locking member towards a blade locking position using the same cantilevered spring, or an additional biasing member.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figures 1, 2:
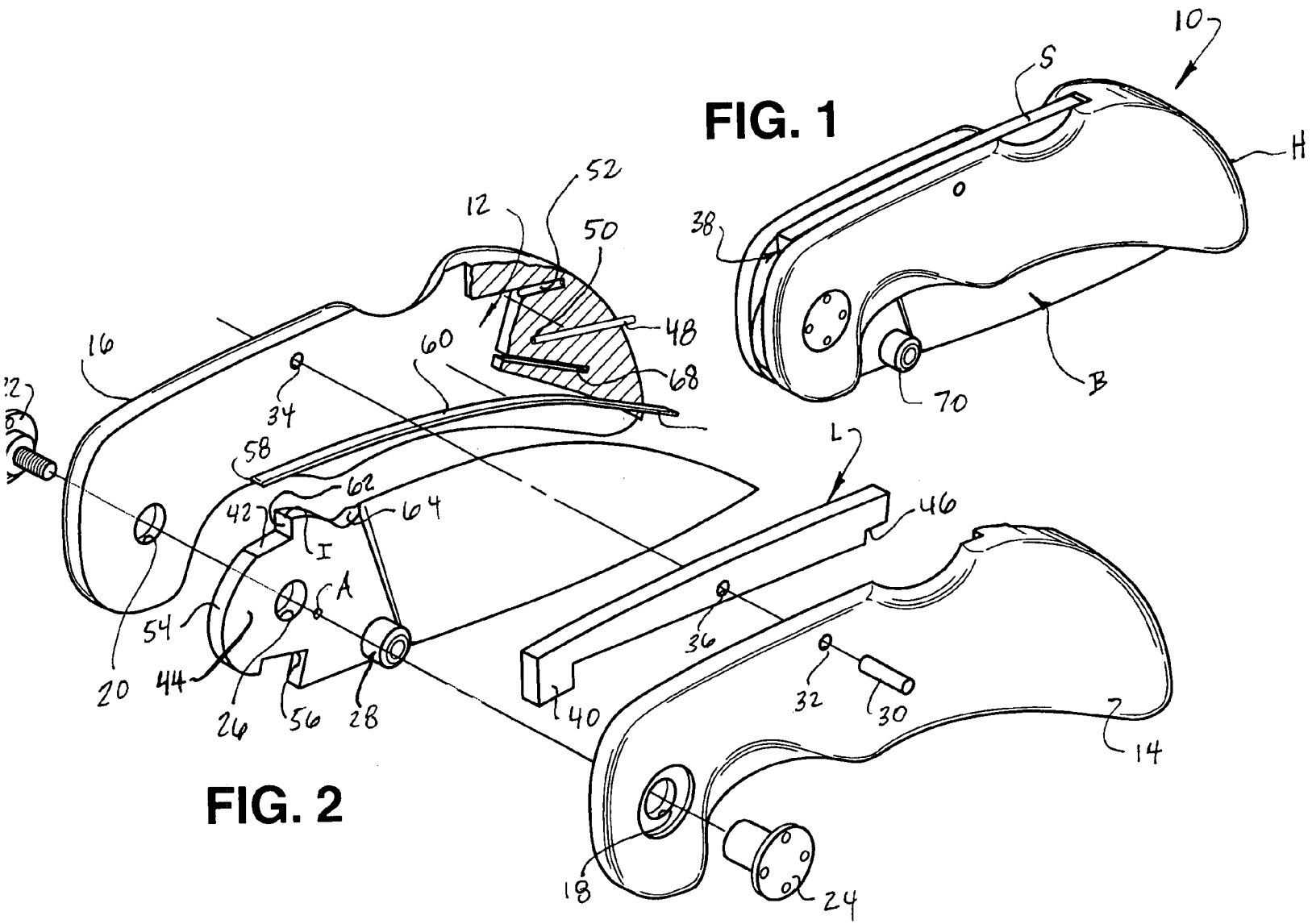
FIG. 1 is a perspective view of a knife constructed in accordance with the present invention, having a blade in a retracted position.
FIG. 2 is an exploded view of the knife shown in FIG. 1.

The accompanying drawings and the description which follows set forth this invention in its preferred embodiment. However, it is contemplated that persons generally familiar with assisted-opening folding knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the assisted-opening folding knife of the present invention is indicated generally in the figures by referencing character 10.

A folding knife constructed in accordance with the present invention 10 is shown in FIG. 1, having a blade, generally B, in a retracted, or closed, position within a blade compartment 12 (FIG. 2) defined by handle members 14, 16, of a handle, generally H. It is to be understood that as used herein, "blade," can refer to a number of items, including a tool, implement, cutting blade, or a holder for such tool, implement, or cutting blade, and is not to be limited to the blade depicted in the Figures.

Figure 3A:
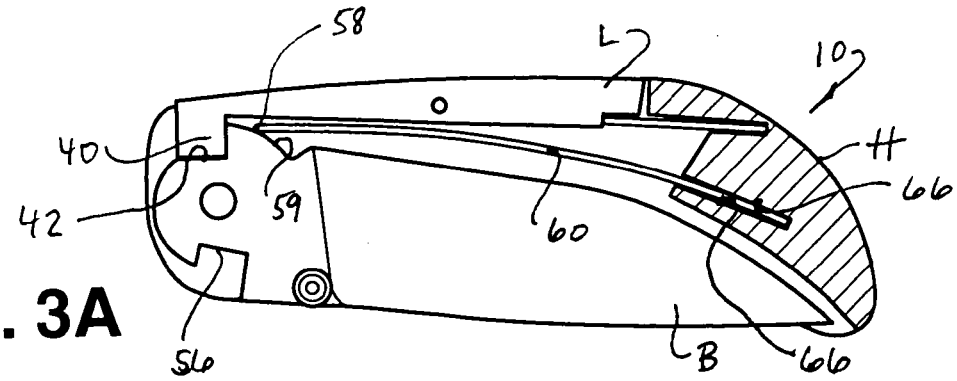
FIG. 3A is a sectional view of the knife shown in FIG. 1, with the blade being in the closed position.

As shown in FIG. 2, handle members 14, 16 are provided with bores 18 and 20 which receive male and female threaded connectors 22, 24. Blade B includes a hole 26 for receipt of a bushing 28 carried by connectors 22, 24, which permits blade B to pivot between the retracted and extended positions in a pivot plane about a pivot axis A, the pivot plane being generally perpendicular to pivot axis A. Bushing 28 provides a pivotal connection blade B with respect to handle H between a retracted position, as shown in FIGS. 1, 2, and 3A, and an extended position, as shown in FIG. 3D.

In addition to connectors 22, 24, pin 30 is provided, which passes through holes 32, 34 of handle members 14, 16, respectively, and also through a hole 36 within a lock member, generally L, which is carried by pin 30 for pivoting movement within a channel 38 (FIG. 1) defined between handle members 14, 16. Lock member L includes a forward portion, having a downwardly extending finger 40 which engages with an locking surface 42 defined in on the tang 44 of blade B, when blade B is in the retracted position. The engagement of finger 40 with locking surface 42 serves to retain blade B within compartment 12, so that blade B does not inadvertently leave compartment 12.

Lock member L includes at its other end a recess 46, on the underside thereof for receipt of a biasing member, which in one preferred embodiment is a wire-type spring 48 having a free end 50 for receipt in recess 46, and an end which is fixed within a channel 52 defined in handle member 16. Spring 48 forces recess 46 of locking member L upwardly, which, in turn, forces finger 40 downwardly into engagement with locking surface 42, when blade B is in a retracted position, as mentioned above, and also, for causing finger 40 to bear against curved profile 54 of tang 44, which spans between locking surface 42 and a lock notch 56 defined in tang 44 generally diametrically opposite from locking surface 42.

Figure 3B:
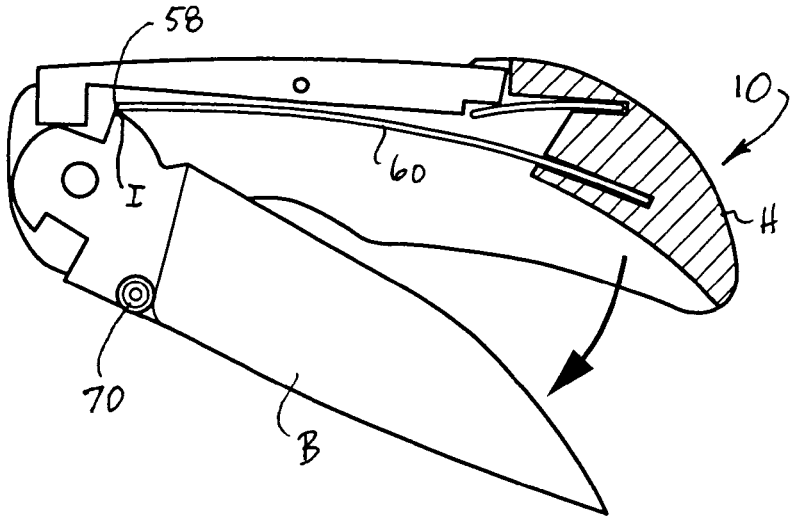
FIG. 3B is a sectional view of the knife shown in FIG. 1, with the blade being in a first intermediate position between the retracted position and the extended position.
Figure 3C:
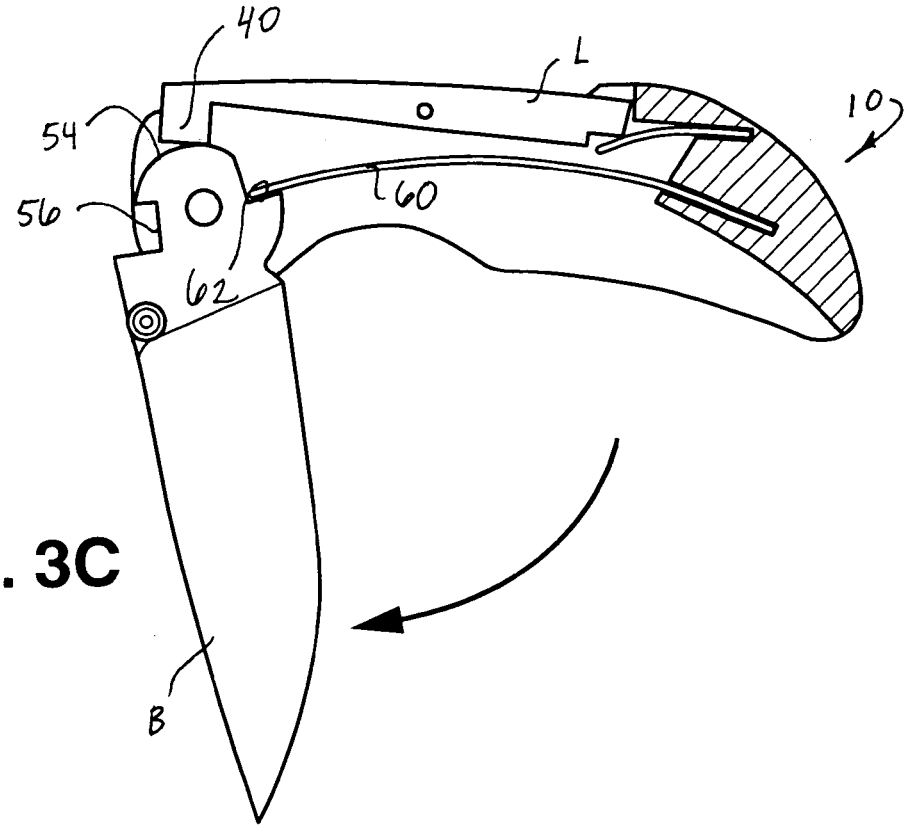
FIG. 3C is a sectional view of the knife shown in FIG. 1, with the blade being in a second intermediate position between the first intermediate position and the extended operable position.
Figure 3D:
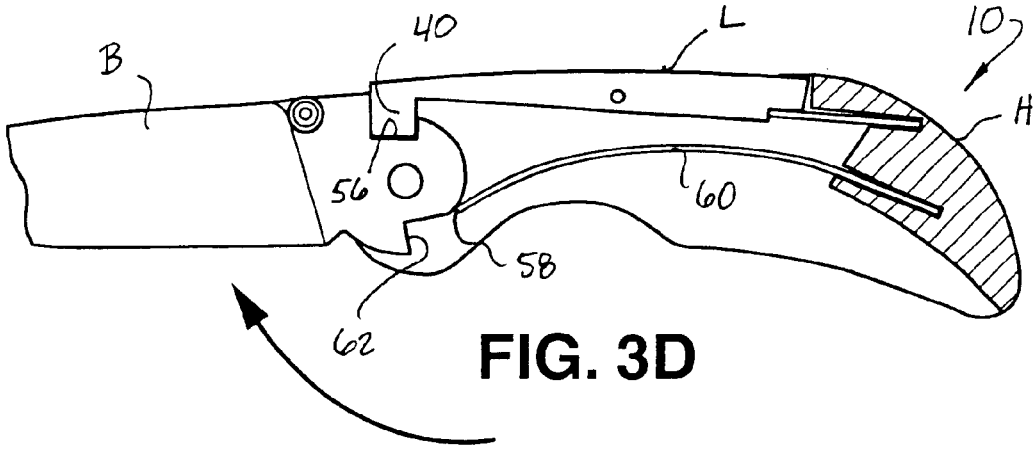
FIG. 3D is a sectional view of the knife shown in FIG. 1, with the blade being in the extended position.

When blade B is in the extended position, as shown in FIG. 3D, finger 40 of lock member L automatically seats within lock notch 56, due to the upward biasing of spring 48 against the underside of lock member L at recess 46, such that blade B is automatically locked in the extended position.

As shown in FIG. 3A, when blade B is in a retracted position, finger 40 of lock member L engages with locking surface 42, and the free-end 58 of a cantilever leaf spring 60 bears against a curved profile 59 of tang 40 which spans between an impelling surface 62 and choil 64 of blade B. The other end 66 of spring 60 is received within a channel 68 of handle member 16 in a generally fixed fashion. It is to be understood that spring 60 is not limited to a leaf spring, but could be a wire, a plastic finger molded or integral with a handle member (not shown), or some other elongated biasing or spring force member.

Spring 60 is biased such that free-end 58 exerts a generally downward force, i.e., towards blade B, as shown in FIG. 3A. This downward biasing of the free-end 58 of spring 60 assists movement of blade B towards the extended position, as discussed in more detail below.

FIG. 3B illustrates blade B being moved from the retracted position towards the extended position, and such movement may be initiated by the user pulling on an upper portion of blade B, or by engaging the thumb/finger stud or post, generally 70, provided on blade B. As shown in FIG. 3B, blade B has been moved such that the free-end 58 of spring 60 is at the intersection I of impelling surface 62 and curved surface 59. Impelling surface 62 extends generally radially with respect to the pivot axis A (FIG. 2) of blade B. As blade B is pivoted slightly further towards the retracted position, the free-end 58 of spring 60 clears such intersection and bears directly against impelling surface 62, and due to the downward force exerted by free-end 58, propels impelling surface 62 with a generally tangential force, which causes blade B to be propelled to the engagement position, under the force of spring 60.

As shown in FIG. 3D, blade B is now in the extended position, having been automatically locked in that position due to the engagement of finger 40 with lock notch 56. Note that free-end 58 of spring 60 is in a generally relaxed position below the pivot axis A of blade B.

Figure 4A:
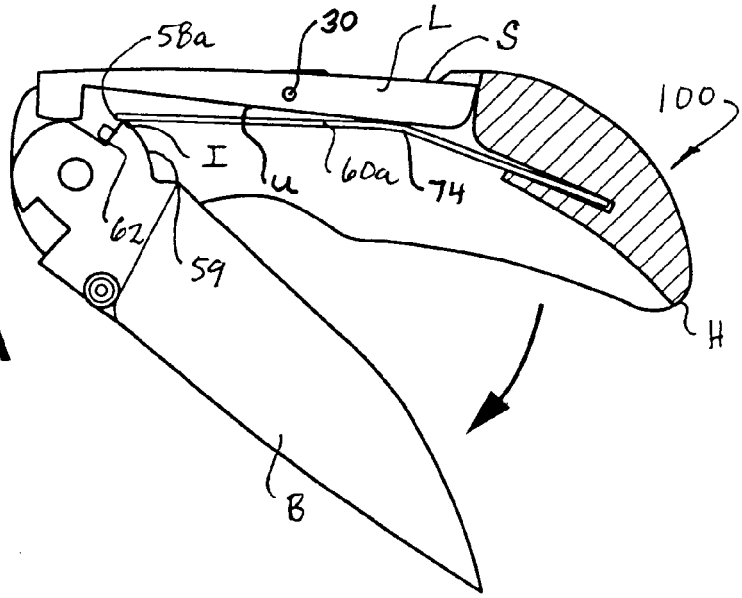
FIG. 4A is a sectional view of a first alternate embodiment of a knife constructed in accordance with the present invention, with the blade being in an intermediate position between the retracted position and the extended position.
Figure 4B:
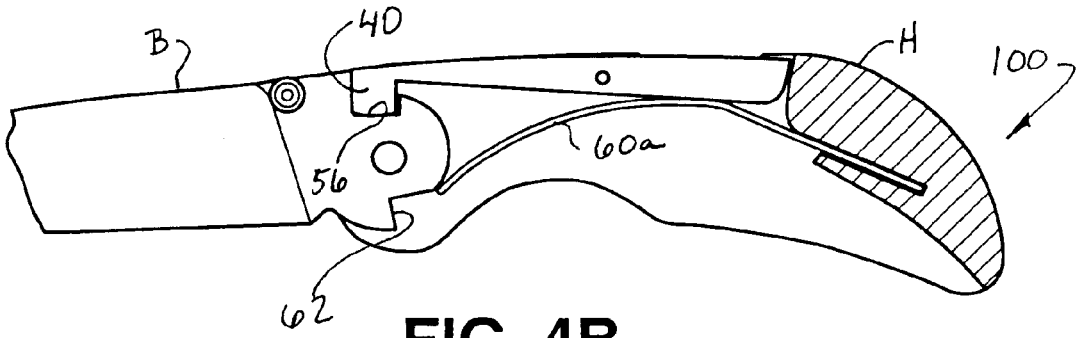
FIG. 4B is a sectional view of the knife shown in FIG. 4A, with the blade in the extended position.

A first alternate embodiment knife 100 of the present invention is illustrated in FIG. 4A. In this embodiment, spring 48 has been eliminated altogether, and cantilever spring 60*a* performs both the function of spring 48, discussed above, in biasing upwardly the rearward portion of lock member L, and in also biasing blade B towards the extended position. FIG. 4A illustrates blade B in a position similarly as shown in FIG. 3B, wherein the free-end 58*a* of spring 60*a*, is at the intersection of impelling surface 62 and curved profile 59. At or near this point, the free-end 58*a* of spring 60*a* engages impelling surface 62 to kick, or impel, blade B to the extended position, shown in FIG. 4B.

Cantilever leaf spring 60*a* includes an apex, or knee, 74 defined at an intermediate portion thereof. This knee 74 bears upwardly on underside U of lock member L to provide finger 40 of lock member L with a downward force such that finger 40 automatically engages with lock notch 56 of blade B upon blade B reaching the extended position.

Figure 5A:
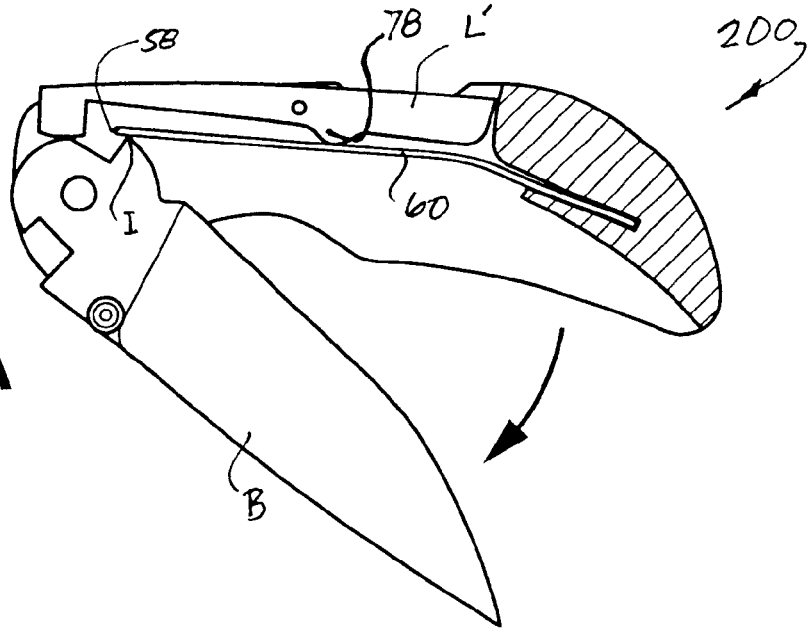
FIG. 5A is a sectional view of a second alternate embodiment of a knife constructed in accordance with the present invention, with the blade being in an intermediate position between the retracted position and the extended position.
Figure 5B:
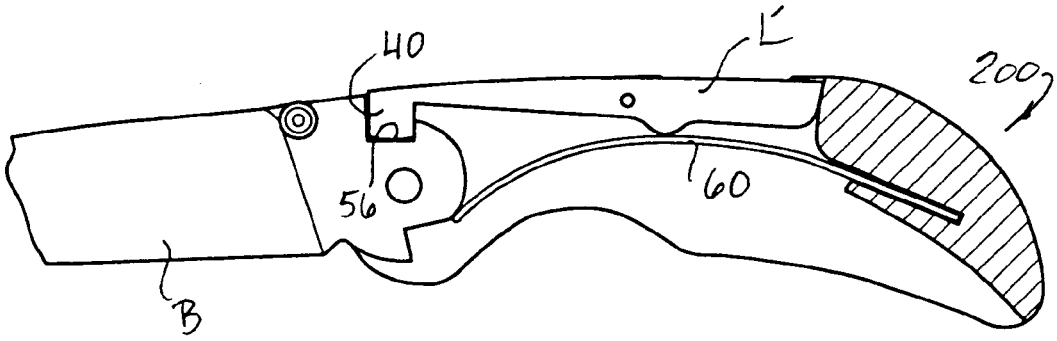
FIG. 5B is a sectional view of the knife shown in FIG. 5A, with the blade in the extended position.

FIGS. 5A and 5B illustrates a second alternate embodiment knife 200 of the present invention. In this embodiment, spring 48 discussed above in regards to knife 10 is also eliminated, as is the case too, with knife 100. Knife 200 includes a lock member L' having a projection 78 on the underside thereof. Projection 78 is positioned rearward of pin 30 and is engaged by cantilever leaf spring 60. Leaf spring 60 may also include an apex, such as discussed above with regard to spring 60*a*, if desired. Leaf spring 60 by virtue of its curvature, exerts an upward force on projection 78, which in turns causes a downward force to be exerted by finger 40 of lock member L'. Thus, when blade B moves to the extended position, finger 40, as discussed above, automatically engages with notch 56 to lock blade B in the extended position.

FIG. 5A illustrates blade B in an intermediate position, with the free-end 58 of leaf spring 60 at or near the point where it exerts tangential force against the end of impelling surface 62 in order to propel blade B to the extended position. Impelling surface 62 is preferably generally radially disposed with respect to pivot axis A, such that the downward force of the free end of a leaf spring provides a maximum moment arm affect delivered torque to impelling surface 62 sufficient for causes blade B to move to the extended position.

It is to be noted that in each of the embodiments of the present invention, i.e., knifes 10, 100, and 200, in order to move blade B from the extended position towards the retracted position, lock member L is depressed downwardly at its rearward end, preferably at or near surface S of lock member L, such that finger 40 is raised out of engagement with lock notch 56 of blade B. This allows the user to then, simultaneously, pivot blade B back to the retracted position.

Components which are common to knives 10, 100, 200, bear the same reference number and perform the same, or generally the same, function as compared to one another.

The free-ends 58, 58*a* of cantilever leaf spring 60, 60*a*, respectively, are preferably rounded and polished to facilitate smooth operation during the transition from contact from intersection I to impelling surface 62, and to the subsequent disengagement with surface 62.

Upon the blade moving approximately twenty degrees from the retracted position, the leaf spring "kicks," or impels, the impelling surface 62 to move the knife to the extended position.

Because of the arrangement of the leaf spring 60, 60*a* are generally in the same plane as blade B, and also in substantially the same plane through which the blade moves between the retracted and extended positions, knifes 10, 100 and 200 can be of a relatively thin profile, since no spring, biasing device, spring and plunger arrangement, etc. is required to be offset to either side of blade B. The resulting thin profile of knives 10, 100, and 200 may provide for less bulk, which may be particularly desirable when such knives are to be carried in a user's pocket, purse, garment, backpack, etc.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. An assisted opening folding knife, comprising:

a handle;

a blade pivotally connected to said handle for pivoting about a pivot axis between an extended position and a retracted position generally adjacent said handle;

said blade having an engagement surface, said engagement surface extending generally radially outwardly with respect to said pivot axis;

said blade defining a blade lock notch generally diametrically opposed from said engagement surface;

a biasing member having a first end connected to said handle and a free end, said free end of said biasing member being configured to automatically contact said engagement surface upon the pivoting of said blade through a predetermined angle from said retracted position; and said biasing member being configured, upon contact of said free end with said engagement surface, to immediately impel said blade towards said extended position.

2. The assisted opening folding knife as defined in claim 1, further comprising said biasing member being configured to urge said blade to said extended position upon said pivoting of said blade through said predetermined angle from said retracted position.

3. The assisted opening folding knife as defined in claim 1, wherein said biasing member is a cantilevered leaf spring.

4. The assisted opening folding knife as defined in claim 1, wherein said predetermined angle is approximately twenty degrees.

5. The assisted opening folding knife as defined in claim 1, wherein said biasing member is elongated and lies substantially in the same plane as said blade.

6. The assisted opening folding knife as defined in claim 1, wherein said biasing member is a cantilevered leaf spring and lies substantially in the same plane as said blade.

7. An assisted opening folding knife, comprising:

a handle;

a blade pivotally connected to said handle for pivoting about a pivot axis between an extended position and a retracted position generally adjacent said handle;

said blade having an engagement surface, said engagement surface extending generally radially outwardly with respect to said pivot axis;

a biasing member having a first end connected to said handle and a free end, said free end of said biasing member being configured to automatically contact said engagement surface upon the pivoting of said blade through a predetermined angle from said retracted position;

said biasing member being configured, upon contact of said free end with said engagement surface, to immediately impel said blade towards said extended position;

an engagement member pivotally connected to said handle and configured for pivoting between a blade locking position, for generally fixing said blade against movement with respect to said handle, and an unlocking position;

an engagement member biasing member urging said engagement member towards said blade locking position; and said engagement member being configured such that upon said blade being in said extended position, said engagement member automatically locks said blade in said extended position.

8. An assisted opening folding knife, comprising:

a handle;

a blade pivotally connected to said handle for pivoting about a pivot axis between an extended position and a retracted position generally adjacent said handle;

said blade having an engagement surface, said engagement surface extending generally radially outwardly with respect to said pivot axis;

a biasing member having a first end connected to said handle and a free end, said free end of said biasing member being configured to automatically contact said engagement surface upon the pivoting of said blade through a predetermined angle from said retracted position;

said biasing member being configured, upon contact of said free end with said engagement surface, to immediately impel said blade towards said extended position;

an engagement member pivotally connected to said handle and configured for pivoting between a blade locking position, for generally fixing said blade against movement with respect to said handle, and an unlocking position;

an engagement member biasing member urging said engagement member towards said blade locking position;

said engagement member being configured such that upon said blade being in said extended position, said engagement member automatically locks said blade in said extended position; and said biasing member, said blade, said engagement member, and said engagement member biasing member all lie in substantially the same plane.

9. An assisted opening folding knife, comprising:

a handle;

a blade pivotally connected to said handle for pivoting about a pivot axis between an extended position and a retracted position generally adjacent said handle;

said blade having an engagement surface, said engagement surface extending generally radially outwardly with respect to said pivot axis;

a cantilevered spring having a first end connected to said handle and a free end, said free end of said cantilevered spring being configured to automatically contact said engagement surface upon the pivoting of said blade through a predetermined angle from said retracted position;

said cantilevered spring being configured, upon contact of said free end with said engagement surface, to immediately impel said blade towards said extended position;

an engagement member pivotally connected to said handle and configured for pivoting between a blade locking position, for generally fixing said blade against movement with respect to said handle, and an unlocking position;

an engagement member biasing member urging said engagement member towards said blade locking position;

said engagement member being configured such that upon said blade being in said extended position, said engagement member automatically locks said blade in said extended position; and wherein said cantilevered leaf spring, said blade, and said engagement member biasing member all lie in substantially the same plane.

10. An assisted opening folding knife, comprising:

a handle;

a blade pivotally connected to said handle for pivoting about a pivot axis between an extended position and a retracted position generally adjacent said handle;

said blade having an engagement surface, said engagement surface extending generally radially outwardly with respect to said pivot axis;

a cantilevered spring having a first end connected to said handle and a free end, said free end of said cantilevered spring being configured to automatically contact said engagement surface upon the pivoting of said blade through a predetermined angle from said retracted position;

said cantilevered spring being configured, upon contact of said free end with said engagement surface, to immediately impel said blade towards said extended position;

an engagement member pivotally connected to said handle and configured for pivoting between a blade locking position, for generally fixing said blade against movement with respect to said handle, and an unlocking position;

an engagement member biasing member urging said engagement member towards said blade locking position;

said engagement member being configured such that upon said blade being in said extended position, said engagement member automatically locks said blade in said extended position; and wherein said cantilevered leaf spring, said blade, and said engagement member all lie in substantially the same plane.

11. An assisted opening folding knife, comprising:

a handle;

a blade pivotally connected to said handle for pivoting about a pivot axis between an extended position and a retracted position generally adjacent said handle;

said blade having an engagement surface, said engagement surface extending generally radially outwardly with respect to said pivot axis;

a biasing member having a first end connected to said handle and a free end, said free end of said biasing member being configured to automatically contact said engagement surface upon the pivoting of said blade through a predetermined angle from said retracted position;

said biasing member being configured, upon contact of said free end with said engagement surface, to immediately impel said blade towards said extended position;

an engagement member pivotally connected to said handle and configured for pivoting between a blade locking position, for generally fixing said blade against movement with respect to said handle, and an unlocking position;

said biasing member urging said engagement member towards said blade locking position; and said engagement member being configured such that upon said blade being in said extended position, said engagement member automatically locks said blade in said extended position.

12. An assisted opening folding knife, comprising:

a handle;

a blade pivotally connected to said handle for pivoting about a pivot axis in a pivot plane between an extended position and a retracted position generally adjacent said handle;

said blade having an engagement surface, said engagement surface extending generally radially outwardly with respect to said pivot axis;

an engagement member connected to said handle and configured for moving generally in said pivot plane between a blade locking position, for generally fixing said blade against movement with respect to said handle, and an unlocking position;

a biasing member having a first end connected to said handle and a free end, said free end of said biasing member being configured to automatically contact said engagement surface upon the pivoting of said blade through a predetermined angle from said retracted position;

said biasing member being elongated and extending along the length thereof generally within said pivot plane; and said biasing member being configured, upon contact of said free end with said engagement surface, to immediately impel said blade towards said extended position.

13. An assisted opening folding knife, comprising:

a handle;

a blade pivotally connected to said handle for pivoting about a pivot axis in a pivot plane between an extended position and a retracted position generally adjacent said handle;

said blade having an engagement surface, said engagement surface extending generally radially outwardly with respect to said pivot axis;

a leaf spring having a first end connected to said handle and a free end, said free end of said leaf spring being configured to automatically contact said engagement surface upon the pivoting of said blade through a predetermined angle from said retracted position;

said leaf spring being configured, upon contact of said free end with said engagement surface, to immediately impel said blade towards said extended position;

an engagement member pivotally connected to said handle and configured for pivoting between a blade locking position, for generally fixing said blade against movement with respect to said handle, and an unlocking position;

said leaf spring urging said engagement member towards said blade locking position; and said engagement member being configured such that upon said blade being in said extended position, said engagement member automatically locks said blade in said extended position.

14. The assisted opening knife as defined in claim 13, wherein said leaf spring and said blade extend generally in and parallel to said pivot plane.

15. An assisted opening folding knife, comprising:

a handle;

a blade pivotally connected to said handle for pivoting about a pivot axis in a pivot plane between an extended position and a retracted position generally adjacent said handle;

said blade having an engagement surface, said engagement surface extending generally radially outwardly with respect to said pivot axis;

a leaf spring having a first end connected to said handle and a free end, said free end of said leaf spring being configured to automatically contact said engagement surface upon the pivoting of said blade through a predetermined angle from said retracted position;

said leaf spring being configured, upon contact of said free end with said engagement surface, to immediately impel said blade towards said extended position;

an engagement member pivotally connected to said handle and configured for pivoting between a blade locking position, for generally fixing said blade against movement with respect to said handle, and an unlocking position;

said leaf spring urging said engagement member towards said blade locking position;

said engagement member being configured such that upon said blade being in said extended position, said engagement member automatically locks said blade in said extended position; and said leaf spring, said blade, and said engagement member extending generally in and parallel to said pivot plane.

16. An assisted opening folding knife, comprising:

a handle;

a blade pivotally connected to said handle for pivoting about a pivot axis in a pivot plane between an extended position and a retracted position generally adjacent said handle;

said blade having an engagement surface, said engagement surface extending generally radially outwardly with respect to said pivot axis;

an engagement member connected to said handle and configured for moving generally in said pivot plane between a blade locking position, for generally fixing said blade against movement with respect to said handle, and an unlocking position;

a biasing member having a first end connected to said handle and a free end, said free end of said biasing member being configured to automatically contact said engagement surface upon the pivoting of said blade through a predetermined angle from said retracted position; and said biasing member being configured, upon contact of said free end with said engagement surface, to immediately impel said blade towards said extended position.

17. An assisted opening folding knife, comprising:

a handle;

a blade pivotally connected to said handle for pivoting about a pivot axis between an extended position and a retracted position generally adjacent said handle;

said blade having an engagement surface, said engagement surface extending generally radially outwardly with respect to said pivot axis;

said blade defining a blade lock portion generally diametrically opposed from said engagement surface;

a biasing member having a first end connected to said handle and a free end, said free end of said biasing member being configured to automatically contact said engagement surface upon the pivoting of said blade through a predetermined angle from said retracted position; and said biasing member being configured, upon contact of said free end with said engagement surface, to immediately impel said blade towards said extended position.

18. An assisted opening folding knife, comprising:

a handle;

a blade pivotally connected to said handle for pivoting about a pivot axis in a pivot plane between an extended position and a retracted position generally adjacent said handle;

said blade having an engagement surface, said engagement surface extending generally radially outwardly with respect to said pivot axis;

an engagement member connected to said handle and configured for moving generally in plane generally parallel to said pivot plane between a blade locking position, for generally fixing said blade against movement with respect to said handle, and an unlocking position;

a biasing member having a first end connected to said handle and a free end, said free end of said biasing member being configured to automatically contact said engagement surface upon the pivoting of said blade through a predetermined angle from said retracted position; and said biasing member being configured, upon contact of said free end with said engagement surface, to immediately impel said blade towards said extended position.

* * * * *